US007419941B2

(12) United States Patent
Waynick

(10) Patent No.: US 7,419,941 B2
(45) Date of Patent: Sep. 2, 2008

(54) LUBRICANT OILS AND GREASES CONTAINING NANOPARTICLES

(75) Inventor: John A. Waynick, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/193,296

(22) Filed: Jul. 29, 2005

(65) Prior Publication Data

US 2007/0293407 A1 Dec. 20, 2007

Related U.S. Application Data

(60) Provisional application No. 60/592,794, filed on Jul. 30, 2004.

(51) Int. Cl.
*C10M 141/10* (2006.01)
*C10M 159/22* (2006.01)
*C10M 169/04* (2006.01)

(52) U.S. Cl. ..... 508/262; 508/154; 508/460; 508/336; 977/773; 977/775

(58) Field of Classification Search ..... 508/162, 508/154, 336, 460; 977/773, 775
See application file for complete search history.

(56) References Cited

U.S. PATENT DOCUMENTS 4,164,472 A * 8/1979 Cheng et al. ..... 508/460
RE31,611 E 6/1984 Wainwright et al.
4,830,767 A 5/1989 Waynick
4,986,923 A 1/1991 Waynick
5,102,565 A 4/1992 Waynick
5,158,694 A * 10/1992 Waynick ..... 508/163
5,207,935 A 5/1993 Waynick
5,223,161 A 6/1993 Waynick
5,460,737 A 10/1995 Sakai et al.
5,523,006 A 6/1996 Strumban
5,652,201 A 7/1997 Papay et al.
5,877,130 A 3/1999 Kohara et al.
6,140,279 A * 10/2000 Emert et al. ..... 508/192
6,531,428 B2 3/2003 Nakazato et al.
6,599,867 B2 7/2003 Hammond et al.
2005/0269548 A1 * 12/2005 Jeffcoate et al. ..... 252/71
2007/0004602 A1 1/2007 Waynick

FOREIGN PATENT DOCUMENTS

WO WO 01/27226 A1 4/2001
WO PCT/US05/27097 11/2006

OTHER PUBLICATIONS

Phys. Chem. Chem. Phys. (PCCP), 2000, 2, pp. 5197-5207; Experimental and Molecular Modelling Studies Of Overbased Detergent Particles; C.A. Berchell, T.N. Danks, D.M. Heyes, D.J. Moreton and S.E. Taylor.

* cited by examiner

*Primary Examiner*—Todd E. Manahan
*Assistant Examiner*—Amy T Lang
(74) *Attorney, Agent, or Firm*—Grossman, Tucker et al

(57) ABSTRACT

Lubricant oil compositions containing a base oil and an additive package comprising one or more wear-resistant additives. The wear-resistant additives can be (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d). The wear-resistant additives are in the form of nanoparticles.

22 Claims, No Drawings

LUBRICANT OILS AND GREASES CONTAINING NANOPARTICLES

This application claims priority to U.S. provisional application Ser. No. 60/592,794, filed Jul. 30, 2004, incorporated herein by reference.

BACKGROUND OF THE INVENTION

This invention pertains to lubricants and greases containing nanoparticles of, for example, carbonate such as calcium carbonate, a carboxylate such as calcium carboxylate, a phosphate such as tricalcium phosphate, and/or calcium sulfate.

Lubricant oils and greases are commonly used for a variety of applications. For example, lubricant oils are used as crankcase lubricants for internal combustion engines, including gasoline and diesel engines. With the current and anticipated emission regulations, automotive manufactures have been conducting research to develop exhaust aftertreatment devices and other mechanical features to meet the new lower emissions standards. Engine oil is affected by these regulations in that it will need to have significantly lower levels of phosphorous in order to avoid the harmful effects over time on the new exhaust aftertreatment devices. This is a problem for the engine oil formulator because for decades zinc dithiophosphates have been the primary wear-resistant additive used for engine oils. Reducing the level of phosphorous in engine oil requires a similar reduction in zinc thiophosphates or other phosphorous-containing wear-resistant additives. The inventor has identified that a need exists to provide a solution to this problem.

SUMMARY OF THE INVENTION

An improved adherent, friction-reducing lubricant oil or grease composition is provided which contains nanoparticles of a carbonate, a carboxylate such as calcium acetate, a phosphate, a sulfate, or a combination of two or more of these materials. As used herein, "nanoparticles" refers to particles having a mean diameter generally less than 1,000 nanometers, more typically less than 100 nanometers, and in one embodiment in the range from 1 to 100 nanometers. In one embodiment, the invention is a lubricant having a low viscosity such as is used as engine oil for gasoline or diesel engines used in automobiles and trucks. Fluid lubricants typically are Newtonian or near-Newtonian whereas greases are non-Newtonian. A Newtonian fluid is one in which the absolute viscosity is independent of the shear rate. A non-Newtonian material is one which the absolute viscosity is dependent of the shear rate. In general, the lubricant lacks a thickener. By contrast, in another embodiment of this invention, the greases of this invention include a base oil and a thickener.

It is believed that the lubricant and grease of this invention provides good friction reduction and provides excellent adherence to the surfaces to be treated, the exact amount of which can be controlled by variations in the levels of the components of its novel composition. It is believed that the lubricant and grease of this invention has outstanding extreme pressure and wear resistance properties which are, advantageously, provided without imparting any corrosivity and with limited amounts of phosphorous containing additives commonly used in lube oils today. This invention provides formulations which may contain phosphorous containing additives, but which use such phosphorous materials in amount within regulatory guidelines and which do not deleteriously impact the aftertreatment devices discussed above. For instance, through the practice of this invention it may be possible to use a zinc thiophosphate in an oil formulation in smaller amounts than previously utilized but which amounts falls within acceptable ranges for regulatory guidelines and the aftertreatment devices. Advantageously, the oils of this invention employ additives of a size small enough to be permanently suspended without settling out. Through use of the additives of this invention, phosphorous containing additives used in the prior art can be limited or omitted entirely. In addition, the nanoparticles would preclude any plugging of oil filters. It is possible that through use of the additives of this invention, frictional heat generated under high loads may be reduced relative to traditional additives. With respect to the greases of this invention, the use of nanoparticles may impart lower noise generation and smoother micro-structure.

In one broad respect, this invention is a lubricant oil composition which comprises: a base oil and an additive package comprising one or more wear-resistant additives, wherein the wear-resistant additives comprise (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d); and wherein the additives are in the form of nanoparticles. In general, the base oil comprises a substantial proportion of the lubricant oil, such as at least 50 percent of the composition. The additive package is present in an amount sufficient to impart antiwear properties to the lubricant, wherein the additive package is in the form of nanoparticles. In general the wear-resistant additives are metal salts of carbonates, sulfates, phosphates and/or carboxylates. The additive package may also provide extreme pressure resistant properties to the compositions of this invention. In one embodiment, the additive package comprises the nanoparticles of a carboxylate such as calcium carboxylate, a carbonate such as calcium carbonate, a phosphate such as monocalcium phosphate, dicalcium phosphate, or tricalcium phosphate, and/or a sulfate such as calcium sulfate. In one embodiment, the lubricant does not contain a thickener such as used in the grease of this invention.

In another broad respect, this invention is a process for manufacturing a lubricant oil composition, comprising: mixing an additive package into a base oil, wherein the additive package comprises one or more wear-resistant additives, and wherein the wear-resistant additives are (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d); and wherein the wear-resistant additives are in the form of nanoparticles.

In another broad respect, this invention is a method for lubricating an internal combustion engine, comprising: using a lubricant oil composition as the motor oil, wherein the lubricant oil composition comprises: a base oil and an additive package comprising one or more wear-resistant additives, wherein the wear-resistant additives are (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d); and wherein the wear-resistant additives are in the form of nanoparticles.

In one broad respect, this invention is a lubricant grease composition which comprises: a base oil, a thickener, and an additive package comprising one or more wear-resistant additives, wherein the wear-resistant additives are (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d); and wherein the additives are in the form of nanoparticles. In general the grease composition contains a substantial proportion of a base oil and thickener. The thickener can be, for example, polyurea, triurea, biurea, calcium soap thickener (simple or complex), lithium soap thickener (simple or complex), aluminum soap thickener (simple or complex), or combinations thereof. The additive package is in general present in an amount sufficient to impart antiwear properties to the grease. In one embodiment, the additive package in the grease composition comprises the nanoparticles of a carboxylate such as calcium carboxylate, a carbonate such as calcium carbonate, a phosphate such as monocalcium phosphate, dicalcium phosphate, or tricalcium phosphate, and/or a sulfate such as calcium sulfate, or a combination thereof.

The grease composition may optionally include a polymeric additive that cooperates and is compatible (non-interfering) with the antiwear additive package to provide retentivity, friction reduction, wear reduction, mobility, and pumpability while also maintaining an environmentally safe product. The polymeric additive can comprise: polyesters, polyamides, polyurethanes, polyoxides, polyamines, polyacrylamides, polyvinyl alcohol, ethylene vinyl acetate, or polyvinyl pyrrolidone; polyolefins (polyalkylenes), such as polyethylene, polypropylene, polyisobutylene, ethylene propylene, and ethylene butylene; or polyolefin (polyalkylene) arylenes, such as polymers of ethylene styrene and styrene isoprene; polyarylene polymers such as polystyrene; polyacrylate, or polymethacrylate; or combinations, or boronated analogs (compounds) of the preceding. Preferably, the polymeric additive comprises: polyolefins (polyalkylenes), such as polyethylene, polypropylene, polyisobutylene, ethylene propylene, and ethylene butylene; or polyolefin (polyalkylene) arylenes, such as ethylene styrene and styrene isoprene; polyarylene polymers such as polystyrene. As used in this application, the term "polymer" means a molecule comprising one or more types of monomeric units chemically bonded together to provide a molecule with at least six total monomeric units. The monomeric units incorporated within the polymer may or may not be the same. If more than one type of monomer unit is present in the polymer the resulting molecule may be also referred to as a copolymer.

In another broad respect, this invention is a process for manufacturing a lubricant grease composition, comprising: mixing an additive package with a base oil and thickener, wherein the additive package includes one or more wear-resistant additives, wherein the additive package comprises (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d); and wherein the additives are in the form of nanoparticles.

In another broad respect, this invention is a process for lubricating a surface, comprising: applying a lubricant grease composition to the surface, wherein the lubricant grease composition comprises a base oil, a thickener, and an additive package, wherein the additive package includes one or more wear-resistant additives, wherein the wear-resistant additives are (a) a Group 1a alkali metal carbonate, a Group 2a alkaline earth metal carbonate, or a mixture thereof; (b) Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; (d) Group 1a alkali metal carboxylate, a Group 2a alkaline earth metal carboxylate; or (e) a combination of (a), (b), (c), and (d); and wherein the additives are in the form of nanoparticles. Typically the surface is made of a metal or metal alloy. In one embodiment the surface is a part in an automobile, truck, train, tractor, or other vehicle including but not limited to ships and airplanes.

The lubricant oil and grease of this invention may be optionally augmented with other antiwear additives such as graphite and molybdenum disulfide, as well as other additives commonly employed in lubricants and greases. Alternatively, such other antiwear additives can be omitted. The grease may be further augmented in its composition by a boron-containing material to further inhibit oil separation.

The use of combinations of carboxylates, carbonates, phosphate, and/or the sulfates may possibly produce good results over the use of improved amounts of any of these additives alone.

In one embodiment, the compositions of this invention are formed in the absence of halogenated materials. Halogenated materials should be avoided when using the additive mixture comprising sulfates and carbonates. Halogenated materials to be avoided include halogenated hydrocarbons, particularly chlorinated paraffins. Such materials exhibit corrosive tendencies at prolonged high temperatures and thereby result in chemical attack to ferrous and non-ferrous metals. This corrosivity is greatly accelerated when water is present. Even small levels of water such as the moisture levels commonly found in air at room temperature are enough to cause catastrophic ferrous corrosion. Furthermore, it is believed that the extremely large synergistic improvement in antiwear properties produced by the sulfate/carbonate mixture is decreased when chlorinated paraffins are also present.

The non-corrosivity of the mixture of calcium sulfate and calcium carbonate at very high temperatures is also in marked contrast to oil-soluble sulfur-containing materials.

In another embodiment, the additive package comprises sulfates and carbonates with a minor amount of hydroxides. The preferred hydroxide is calcium hydroxide. The addition of calcium hydroxide to the sulfate/carbonate mixture imparts improved wear resistance to the oil or grease and also provides additional overbasing to neutralize acidic materials which form over long periods of time as the oil or grease oxidizes.

DETAILED DESCRIPTION OF THE INVENTION

The lubricating oil of this invention, in general, comprises the base oil and the additive package of nanoparticles. In general, the base oil is present in an amount of at least about 75% by weight, alternatively at least 80%, and in one embodiment at least 90%, based on the total weight of the lubricant oil composition including all other components. In general, the base oil is present in an amount of less than about 99% by weight, and in one embodiment less than about 95% by weight. In general the additive package is present in an amount up to 10% by weight, in one embodiment up to 8%. In general the additive package is present in an amount of at least 0.1% and in one embodiment at least 1%.

The grease of this invention, in general, comprises by weight: 45% to 90% base oil, 5% to 20% thickener, and 0.5% to 30% antiwear additives. If present, the amount of the polymer is from 1% to 10% of adhesive polymer. In one embodiment, the lubricating grease comprises by weight: at least 65% base oil, at least 3% thickener, and 8% to 20% extreme pressure antiwear additives. When the grease is thickened substantially by polyurea, triurea, biurea, calcium soaps (simple or complex), lithium soaps (simple or complex), or aluminum soaps (simple or complex), or combinations thereof, the lubricating grease typically comprises by weight 3% to 14% of said thickener. In one embodiment, the lubricating grease comprises by weight 4% to 8% of said thickener.

The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 SUS at 100 F.

Other hydrocarbon oils can also be used, such as: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl) siloxane and poly(methyl)phenylsiloxane.

The preferred base oil comprises about 65% by weight of a refined, solvent-extracted, hydrogenated, dewaxed base oil, preferably 850 SUS oil, and about 35% by weight of another refined solvent-extracted dewaxed base oil, preferably 150 SUS oil, for better results. Type II, II+, and III base are the most preferred currently.

Thickeners useful in the lubricating grease include polyurea, calcium soaps (simple and complex), lithium soaps (simple and complex), and aluminum soaps (simple and complex). Polyurea thickeners are preferred over other types of thickeners because they have high dropping points, typically 460 F. to 500 F., or higher. Polyurea thickeners are also advantageous because they have inherent antioxidant characteristics, work well with other antioxidants, and are compatible with all elastomers and seals.

The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

In order to attain extreme pressure properties, antiwear qualities, and/or friction reduction properties, as well as any elastomeric compatibility which may be required, the additives in the additive package may comprise a carboxylate, a sulfate, a phosphate and/or a carbonate. Each component, if present, is in an amount of from 0.1 to 10% of the lubricant oil composition or grease composition.

Desirably, the mean particle size of the carboxylate, carbonate, phosphate, and sulfate is generally less than about 100 nanometers. In one embodiment, the mean size is from 1 to 100 nanometers.

The preferred carbonate additive is calcium carbonate. While calcium carbonate is preferred, other carbonate additives can be used, if desired, in conjunction with or in lieu of calcium carbonate, such as the carbonates of Group 2a alkaline earth metal, such as beryllium, magnesium, calcium, strontium, and barium, or the carbonates of a Group 1a alkali metal, such as lithium, sodium, and potassium. Desirably, calcium carbonate is less expensive, less toxic, more readily available, safer, and more stable than other carbonates. Calcium carbonate is also superior to calcium bicarbonate. Calcium carbonate is also water insoluble. Calcium bicarbonate, however, has an acidic proton which at high temperatures can corrosively attack metal surfaces.

While calcium sulfate is preferred, other sulfate additives can be used, if desired, in conjunction with or in lieu of calcium sulfate, such as the sulfates of Group 2a alkaline earth metal, such as beryllium, magnesium, calcium, strontium, and barium, or the sulfates of a Group a1 alkali metal, such as lithium, sodium, and potassium. Desirably, calcium sulfate is less expensive, less toxic, more readily available, and safer. Calcium sulfate is also superior to calcium bisulfate. Calcium sulfate is also essentially water insoluble and will not wash out of the grease when contamination by water occurs.

The carboxylates used in this invention are of a Group 2a alkaline earth metal, such as beryllium, magnesium, calcium, strontium, and barium, or a Group 1a alkali metal, such as lithium, sodium, and potassium. The carboxylates are of a Group 2a alkaline earth metal or of a Group 1a alkali metal such as those described above. Representative carboxylates include acetates, proprionates and other carboxylates having up to 12 carbons. A representative example of such carboxylates includes calcium acetate.

The phosphates used in this invention are of a Group 2a alkaline earth metal, such as beryllium, manganese, calcium, strontium, and barium, or of a Group 1a alkali metal, such as lithium, sodium, potassium, rubidium, cesium, and francium. For example, monocalcium phosphate, dicalcium phosphate, and tricalcium phosphate can be employed in the practice of this invention.

The additive package can further comprise calcium hydroxide. A relatively minor level of calcium hydroxide, when added to the oil or grease, may improve the wear resistance properties. Also, the calcium hydroxide provides additional excess alkaline reserve which can be useful to help neutralize any acidic products which may result from high temperature oxidation of the grease over long periods of time. Preferably, the calcium hydroxide, when present, should be present at 0.01% to 5% by weight of the grease.

The additive package may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl) amine, N,N diphenyl-p-phenylenediamine, 2,2,4 trimethyldihydroquinoline oligomer, bis(4 isopropylaminophenyl)- ether, N-acyl-p-aminophenol, N-acylphenothiazines, N of ethylenediamine tetraacetic acid, and alkylphenol-formaldehyde-amine polycondensates.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Other ferrous corrosion inhibitors include certain salts of aromatic acids and polyaromatic acids, such as zinc naphthenate.

Metal deactivators can also be added to further prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines. Although such metal deactivators can be added to the grease, their presence is not normally required due to the extreme nonreactive, noncorrosive nature of the railroad track/wheel flange grease composition.

For the lubricant oil compositions, dispersants may optionally be employed to add dispersion stability for the nanoparticles. Such dispersants may be especially useful after the oil has been stressed during use, including heat and cold cycles. The dispersants can be selected from conventional dispersants and appropriately matched to the nanoparticles present in a given formulation. When used, the amount of dispersant will typically be in the range of 0.01 to 10 percent by weight of the total composition.

In any of the above described forms of the lubricating grease, boron-containing oil separation inhibitors can be optionally added. It was found that borates or boron-containing materials such as borated amine, when used in greases in the presence of calcium phosphates and calcium carbonates, act as an oil separation inhibitor, which is especially useful at high temperatures. Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company. Other useful borates include borates of Group 1a alkali metals, borates of Group 2a alkaline earth metals, stable borates of transition metals (elements), such as zinc, copper, and tin, boric oxide, and combinations of the above. These borated materials may also be used when soap thickeners or mixtures of polyurea and soap thickeners are used. When boron-containing oil separation inhibitors are used in the grease they should be present at 0.01% to 10%, preferably 0.1% to 5%, and most preferably 0.25% to 2.5%, by weight of the boron-containing material in the total grease. Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines.

Other solid additives in nanoparticle form may be used in this invention in addition to, or as an alternative to the carbonates, carboxylates, and sulfates. Such other solid additives in nanoparticle form included but are not limited graphite, molybdenum disulfide, and TEFLON polymers.

What is claimed is:

1. A lubricant oil composition, comprising: a base oil selected from Type II, II+ or III base oil present in said composition at a level of at least 90% of the total weight of the composition, a dispersant present in the range of 0.01 to 10 percent by weight of the total composition and an additive package comprising wear-resistant suspended nanoparticles, wherein the wear-resistant nanoparticles are (a) a Group 1a alkali metal carbonate, a Group 2a alkaline earth metal carbonate, or a mixture thereof; (b) a Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; and (d) a Group 1a alkali metal carboxylate, a Group 2a alkaline earth metal carboxylate or a mixture thereof; and wherein each of the wear-resistant nanoparticles are present in an amount of 0.1 to 10% of the total composition and the nanoparticles have a mean diameter in the range from 1 to 100 nanometers.

2. The composition of claim 1, wherein the wear-resistant nanoparticles are calcium salts.

3. The composition of claim 1, wherein the base oil is present in an amount of least 90% by weight.

4. The composition of claim 1, wherein the additive package is present in an amount in the range from about 0.1% to about 10% by weight.

5. The composition of claim 1, wherein said carbonate is calcium carbonate.

6. The composition of claim 1, wherein said sulfate is calcium sulfate.

7. The composition of claim 1, wherein said carboxylate is calcium carboxylate.

8. The composition of claim 1, wherein said phosphate is calcium phosphate.

9. The composition of claim 1, further comprising calcium hydroxide.

10. A process for manufacturing a lubricant oil composition, comprising: mixing an additive package into a base oil selected from Type II, II+ or III base oil present in said composition at a level of at least 90% of the total weight of the composition, and a dispersant present in the range of 0.01 to 10 percent by weight of the total composition, wherein the additive package comprises suspended wear-resistant nanoparticles, and wherein the wear-resistant nanoparticles are (a) a Group 1a alkali metal carbonate, a Group 2a alkaline earth metal carbonate, or a mixture thereof; (b) a Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; and (d) a Group 1a alkali metal carboxylate, a Group 2a alkaline earth metal carboxylate or a mixture thereof; and wherein the wear-resistant of nanoparticles have mean diameter in the range from 1 to 100 nanometers.

11. The process of claim 10, wherein the wear-resistant nanoparticles are calcium salts.

12. The process of claim 10, wherein the base oil is present in an amount of least 90% by weight.

13. The process of claim 10, wherein the additive package is present in an amount in the range from about 0.1% to about 10% by weight.

14. The process of claim 10, wherein said carbonate is calcium carbonate.

15. The process of claim 10, wherein said sulfate is calcium sulfate.

16. The process of claim 10, wherein said carboxylate is calcium carboxylate.

17. The process of claim 10, wherein said phosphate is calcium phosphate.

18. The process of claim 10, further comprising calcium hydroxide.

19. A method for lubricating an internal combustion engine, comprising: using a lubricant oil composition as the motor oil, wherein the lubricant oil composition comprises: a base oil selected from Type II, II+ or III base oil present in said composition at a level of at least 90% of the total weight of the composition, a dispersant present in the range of 0.01 to 10 percent by weight of the total composition, and an additive package comprising suspended wear-resistant nanoparticles, wherein the wear-resistant nanoparticles are (a) a Group 1a alkali metal carbonate, a Group 2a alkaline earth metal carbonate, or a mixture thereof; (b) a Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; and (d) a Group 1a alkali metal carboxylate, a Group 2a alkaline earth metal carboxylate, or a mixture thereof; and wherein each of the wear-resistant nanoparticles are present in an amount of 0.1 to 10% of the total composition and the wear-resistant of nanoparticles have a mean diameter in the range from 1 to 100 nanometers.

20. A lubricant grease composition, comprising: a base oil selected from Type II, II+ or III base oil, a dispersant present in the range of 0.01 to 10 percent by weight of the total composition, a thickener, and an additive package comprising suspended wear-resistant nanoparticles, wherein the wear-resistant nanoparticles are (a) a Group 1a alkali metal carbonate, a Group 2a alkaline earth metal carbonate, or a mixture thereof; (b) a Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; and (d) a Group 1a alkali metal carboxylate, a Group 2a alkaline earth metal carboxylate or a mixture thereof; and wherein each of said wear-resistant nanoparticles are present in an amount of 0.1 to 10% of the total composition and the wear-resistant nanoparticles have a mean diameter in the range from 1 to 100 nanometers.

21. A process for manufacturing a lubricant grease composition, comprising: mixing an additive package with a base oil selected from Type II, II+ or III base oil, a dispersant present in the range of 0.01 to 10 percent by weight of the total composition, and thickener, wherein the additive package includes one or more suspended wear-resistant nanoparticles, wherein the additive package comprises (a) a Group 1a alkali metal carbonate, a Group 2a alkaline earth metal carbonate, or a mixture thereof; (b) a Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; and (d) a Group 1a alkali metal carboxylate, a Group 2a alkaline earth metal carboxylate or a mixture thereof; and wherein each of said wear-resistant nanoparticles are present in an amount of 0.1 to 10% of the total composition and the nanoparticles have a mean diameter in the range from 1 to 100.

22. A process for lubricating a surface, comprising: applying a lubricant grease composition to the surface, wherein the lubricant grease composition comprises a base oil selected from Type II, II+ or III base oil, a dispersant present in the range of 0.01 to 10 percent by weight of the total composition, a thickener, and an additive package, wherein the additive package includes suspended wear-resistant nanoparticles, wherein the wear-resistant nanoparticles are (a) a Group 1a alkali metal carbonate, a Group 2a alkaline earth metal carbonate, or a mixture thereof; (b) a Group 1a alkali metal sulfate, a Group 2a alkaline earth metal sulfate, or a mixture thereof; (c) a Group 1a alkali metal phosphate, a Group 2a alkaline earth metal phosphate, or a mixture thereof; and (d) a Group 1a alkali metal carboxylate, a Group 2a alkaline earth metal carboxylate or a mixture thereof; and wherein each of said wear-resistant nanoparticles are present in an amount of 0.1 to 10% of the total composition and the nanoparticles have a mean diameter in the range from 1 to 100 nanometers.

* * * * *